US005806981A

United States Patent [19]

Schisler

[11] Patent Number: 5,806,981

[45] Date of Patent: Sep. 15, 1998

[54] PACKAGING BAG FOR CARRYING FOOD

[76] Inventor: Jacques Schisler, 22, chemin des Graines, 79100 Thouars, France

[21] Appl. No.: 785,765

[22] Filed: Jan. 21, 1997

[30] Foreign Application Priority Data

Mar. 25, 1996 [FR] France ..... 96 03689

[51] Int. Cl.[6] ..... B65D 30/22

[52] U.S. Cl. ..... 383/38; 229/120.29; 229/120.32

[58] Field of Search ..... 383/38; 229/120.06, 229/120.29, 120.31, 120.32, 120.37, 120.38, 904, 907, 932

[56] References Cited

U.S. PATENT DOCUMENTS

| | | | |
|---|---|---|---|
| 1,158,349 | 10/1915 | Whalen | 383/38 X |
| 1,228,822 | 6/1917 | Ries | 383/38 X |
| 1,349,535 | 8/1920 | Smith | 383/38 X |
| 1,456,897 | 5/1923 | Mc Grath . | |
| 1,628,718 | 5/1927 | Fritzsche | 229/932 X |
| 2,112,406 | 3/1938 | Metro | 383/38 |
| 4,708,248 | 11/1987 | Davis . | |
| 4,832,188 | 5/1989 | Christie . | |
| 5,071,007 | 12/1991 | Kadien . | |

*Primary Examiner*—Jes F. Pascua
*Attorney, Agent, or Firm*—Young & Thompson

[57] ABSTRACT

A carrying bag of the foldable type, comprises a separator element (3) which is adapted to occupy two positions, namely a storage position in which it is applied against the wall (1*a*) of the bag (1) and a use position in which it extends substantially parallel to the bottom (1*c*) of the bag. The separator plate (3) comprises at least one opening (7) adapted to receive a cup. The bag comprises a transverse flap (3*a*) articulated on the separator plate (3), which in its storage position includes a tongue (6) located below the separator plate (3) and a recess adapted to receive a cup (9). When in place within the recess, the cup comes to bear against the tongue (6) so as to ensure the maintenance of the flap (3*a*) substantially perpendicular to the separator plate (3).

9 Claims, 3 Drawing Sheets

PACKAGING BAG FOR CARRYING FOOD

FIELD OF THE INVENTION

The present invention relates to a packaging bag and more particularly a bag adapted for transporting foods as well as cups containing liquids.

BACKGROUND OF THE INVENTION

Vendors who sell food products, such as particularly sandwiches or plates of food, also supply to the customers beverages contained in cups which are usually closed by a cover. Most of the time, this cover is not sufficiently sealed to prevent, during the course of carrying, the cup of beverage from inverting within the bag, the liquid spilling within the latter. There are similar drawbacks for other products which are adapted to be transported in a vertical posture, such as for example bags of french fries.

It has been proposed particularly in U.S. Pat. No. 408,248, to provide a carrying bag for food which comprises an element for holding cups, constituted by a substantially rigid plate, which is fixed on the internal surface of one of the walls of the bag, and which is adapted to occupy two positions, namely, a rest position in which it is applied against an internal wall of the bag and a use position in which it extends substantially transversely to this wall within the bag, this holding plate comprising at least one opening adapted to ensure, when it is in the use position, the maintenance in a fixed predetermined position of an object and particularly a cup.

In bags of this type, the holding plate extends over all of the cross section of the base of the bag, so that to arrange in the latter other products than cups maintained by the plate, it is necessary to have a second rigid plate which, in use position, bears on the upper surface of the cups maintained by the first plate, so as to receive the other products.

Bags of this type have a first drawback which is the complexity of the device to be emplaced in the bag, because it is necessary to have two superposed plates, each maintained by tongues which are glued to the internal wall of the bag.

A second drawback of these devices is that they do not permit ensuring good thermal insulation between the cups ordinarily containing hot or cold beverages, and the upper part of the bag which is adapted to receive the food.

SUMMARY OF THE INVENTION

The present invention has for its object to provide a packaging bag of the type described above which will be of a particularly simple construction, and hence of reduced cost, and which moreover permits ensuring good thermal insulation between the hot or cold beverages contained in the cups, and the food.

The present invention thus has for its object a carrying bag of the foldable type comprising a separator element constituted by a substantially rigid plate which is fixed on the internal surface of one of the walls of the bag, this separator plate being adapted to occupy two positions, namely, a storage position in which it is applied against said wall of the bag and a use position in which it extends transversely to this wall within the bag, substantially parallel to the bottom of the latter, this separator plate comprising at least one opening adapted to ensure, when the plate is in the use position, the maintenance in a fixed predetermined position, and particularly in a vertical position, of an object such as a cup, characterized in that:

it comprises a transverse flap which is articulated on the separator plate, so as to be within the plane of the latter in the storage position and perpendicular to the latter in the use position, this flap comprising, in this latter position, a portion or tongue located below and a portion located above the separator plate, the separator plate comprises an opening adjacent the flap, which is adapted to admit an object, particularly a cup, which, when it is in position in said opening, comes to bear against the tongue so as to ensure the maintenance of the flap substantially perpendicular to the separator plate.

In one embodiment of the invention, the length of the tongue is equal to the distance which separates the separator plate from the bottom of the bag when the plate is located in the use position.

In another embodiment of the invention, the flap is of the same piece as the separator plate.

Moreover, the separator plate can comprise, on one of its longitudinal sides, a bendable leg which comes into contact, in the use position, with the bottom of the bag.

BRIEF DESCRIPTION OF THE DRAWINGS

There will be described hereafter, by way of nonlimiting examples, various embodiments of the present invention, with reference to the accompanying drawings, in which.

DETAILED OF THE PREFERRED EMBODIMENTS

Figure 2:
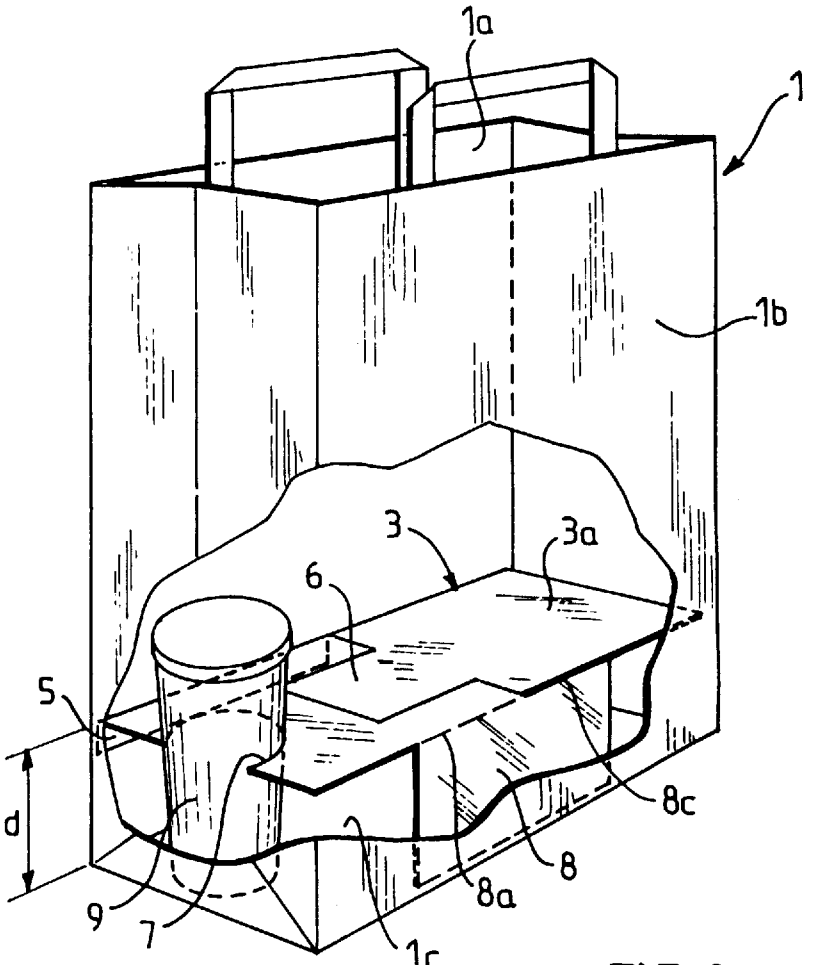
FIG. 2 is a perspective view of a carrying bag according to the invention, shown in a position intermediate the storage position and the use position.

There is shown in FIGS. 1 to 5, a bag 1 according to the invention which comprises two main vertical walls 1*a* and 1*b*. The bag 1 is provided with a separator plate 3 which is constituted of a sheet of cardboard folded and cut such as shown in plan in FIG. 6. The separator plate 3 comprises a securement leg 5 which is constituted by a lateral strip of small width which extends over a portion of the length, and which is glued on the internal surface of a principal wall 1*a* of the bag 1, at a distance d from the bottom 1*c* parallel to the latter. The separator plate 3 comprises a circular opening 7 which opens onto one of the transverse sides of the plate 3, and which is adapted to receive a cup, particularly a truncated conical cardboard cup 9. The separator plate 3 comprises moreover a U-shaped cutout which forms a tongue 6. This cutout, as shown in FIG. 6, is formed by two legs 6*a* parallel to the longitudinal axis xx' of the plate 3, which are interconnected by a transverse leg 6*b*.

Preferably, the distance d separating the separator plate 3 from the bottom 1*c* of the bag 1 and the diameter of the opening 7 are such that the truncated conical cups 9 can both wedge within the recess 7 and have their bottom in bearing relationship on the bottom 1*c* of the bag 1. Under these circumstances, the truncated cups 9 take part in maintaining the plate 3 in a position parallel to the bottom 1*c*.

Moreover, the longitudinal side of the plate 3, opposite the securement leg 5, comprises a leg 8 whose transverse dimension is equal to the distance d of the plate 3 to the bottom 1*c* of the bag such that, in the use position, the leg 8 comes to bear on the bottom 1*c* of this latter. The leg 8 comprises a bend line 8*a* (shown in broken line in FIG. 6) which merges with the longitudinal edge of the plate 3, this bend line being cut out in a region 8*c* which extends from the upper portion of the U-shaped cutout, to its longitudinal end at the side opposite said U-shaped cutout.

Figure 6:
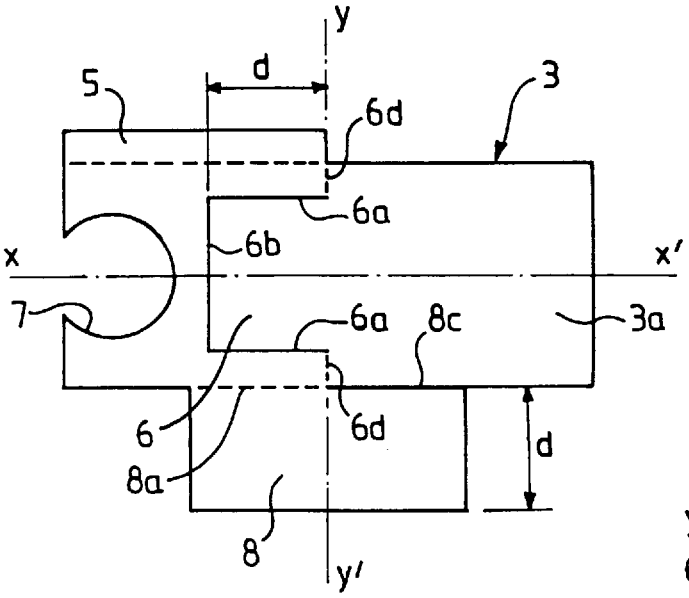
FIG. 6 is a plan view of a separator plate used in the bag according to the invention.
Figure 7:
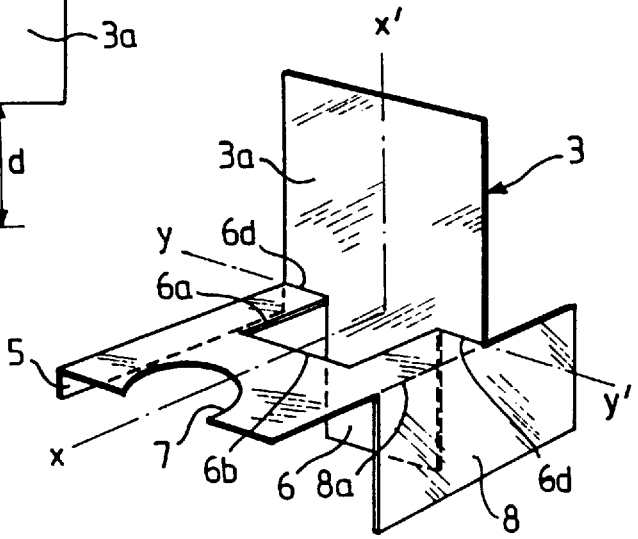
FIG. 7 is a perspective view of the separator plate shown in FIG. 6, after bending.

The portion of plate 3 opposite to that comprising the circular recess 7, thus forms a flap 3*a* which can pivot about two bend segments 6*d* (shown in long broken lines on FIG. 6) with a transverse axis yy', which are located at the upper end of the legs 6*a,* which form hinges, as shown in FIGS. 6 and 7.

The separator plate 3 is adapted to occupy two positions, namely a first position, or storage position (FIGS. 1 and 5) in which it is applied against the principal wall 1*a* of the bag 1 to which it is fixed, which permits bending and storage of the bag, and a second position, or use position (FIGS. 3 and 4), in which the separator plate 3 is in a position parallel to the bottom 1*c* of the bag 1, such that the leg 8 is in contact with the latter, and the flap 3*a* is in a vertical position. In this position, the cutting lines 6*a* and 6*b* delimit a rectangular opening adjacent the flap 3*a*. The dimensions of this opening will be such as to permit the reception of a second cup 9. It is interesting that these dimensions will be such that the emplacement of the cup 9 takes place with slight friction, which has the effect of improving its holding.

According to the invention, when a cup 9 is emplaced in the opening adjacent the flap 3*a,* this cup bears on the tongue 6 of the flap 3*a* and thus ensures immobilization of the latter in the vertical position.

It is thus possible to effect an easy and rapid separation of the interior of the bag 1, into two compartments, namely, a first compartment comprising cups 9 enclosing liquid foodstuffs at a given temperature and a second adjacent compartment which extends over the total height of the bag 1, which is insulated from the first by the flap 3*a* and in which it is possible to store particularly foodstuffs which are at a temperature different from the beverages stored in the first compartment.

Figure 4:
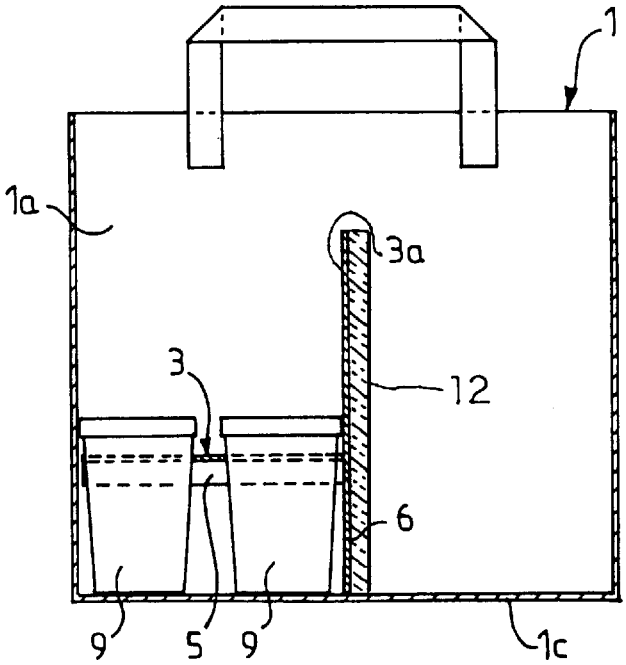
FIG. 4 is a vertical and longitudinal cross-sectional view of the bag shown in FIG. 3, a second cup being in place.

As depicted in FIG. 4, and so as to improve the insulating nature of flap 3*a,* the latter can be clad with a thermally-insulating material 12, such as particularly synthetic products. All of the plate 3 can also be clad with such an insulating material.

It is also possible according to the invention to provide the plate 3 to be a material having good characteristics of mechanical rigidity and thermal insulation.

Preferably, the height of the legs 6*a* of the cutout forming the tongue 6 will be equal to the distance d which separates the plate 3 from the bottom 1*c* of the bag 1. This embodiment permits creating a second bearing for the plate 3 relative to the bottom of bag 1*c* when the flap 3*a* of this latter will be in vertical position, which has the effect of increasing the rigidity of the assembly.

Figure 8:
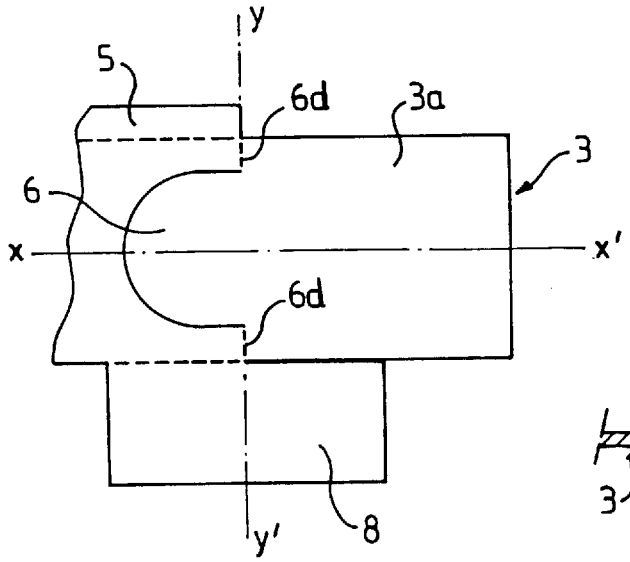
FIG. 8 is a fragmentary plan view of a modified embodiment of the invention.

Of course the cutout region of U-shape could have a different shape, as shown in FIG. 8.

Figure 1:
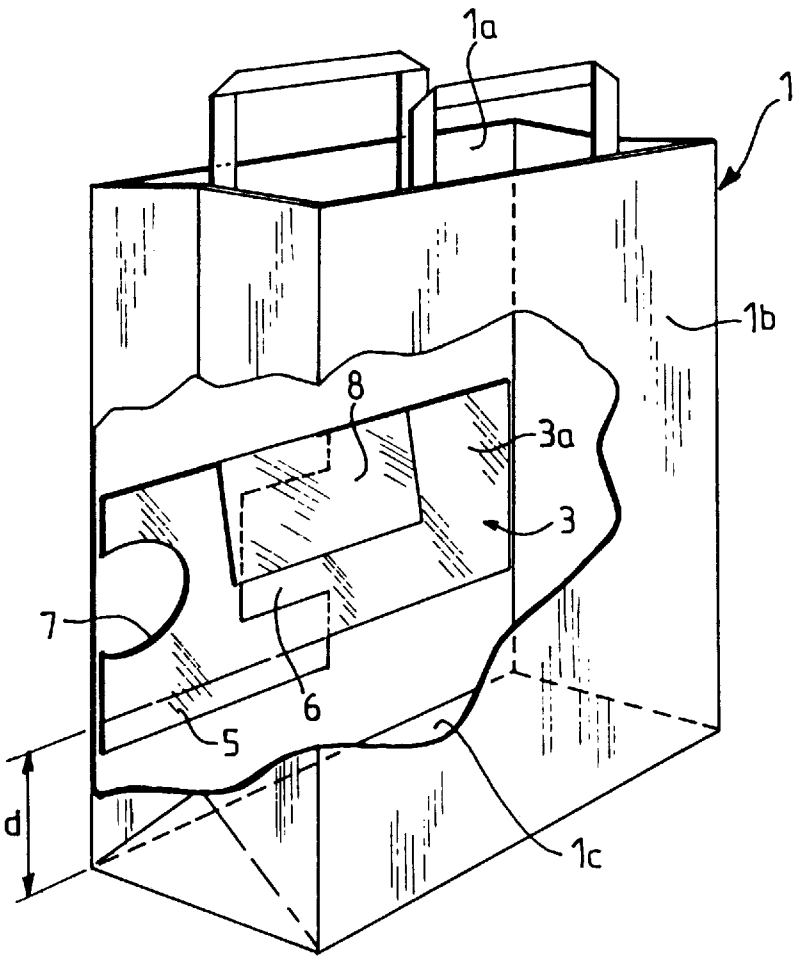
FIG. 1 is a perspective view of a carrying bag according to the invention, shown in its storage position.
Figure 3:
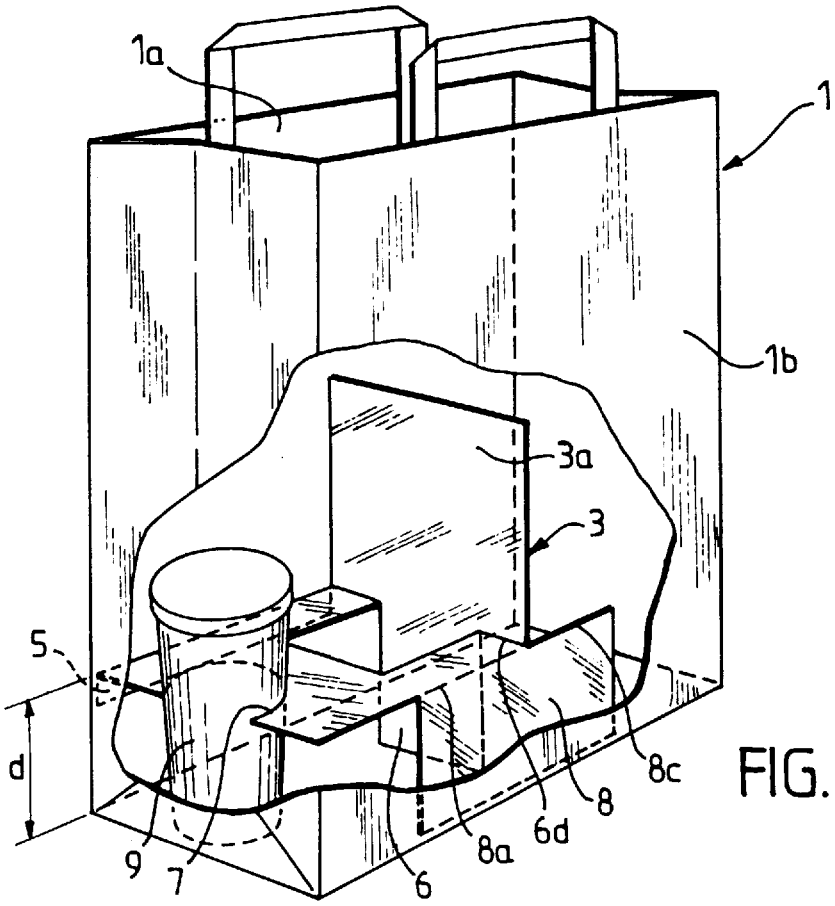
FIG. 3 is a perspective view of a carrying bag according to the invention, shown in its use position.

As shown in FIG. 1, when the separator plate 3 is not used, it is folded against the wall 1*a* of the bag, whereupon this latter can be used normally as a bag of conventional type.

Figure 5:
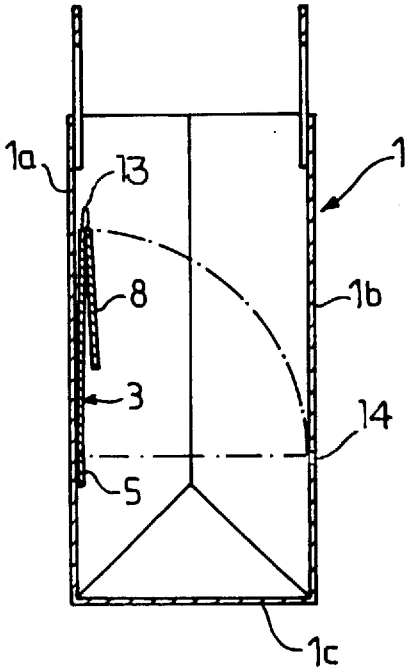
FIG. 5 is a vertical and transverse cross section of the bag shown in FIG. 1.

The leg 8 ensuring the maintenance in use position of the separator plate 3 could also be replaced by an adhesive securement. To this end there is formed, on the edge opposite the securement leg 5, one or several tongues whose external surface receives an adhesive product which adheres to the internal surface of the wall 1*b* of the bag 1. As seen in FIG. 5, one could also, in use position, ensure the maintenance of the separator plate 3 parallel to the bottom 1*c* of the bag 1 by means of one or several tongues 13 of small dimensions secured to the latter which, in use position, enter suitable opening 14 of the wall 1*b* of the bag.

Figure 9:
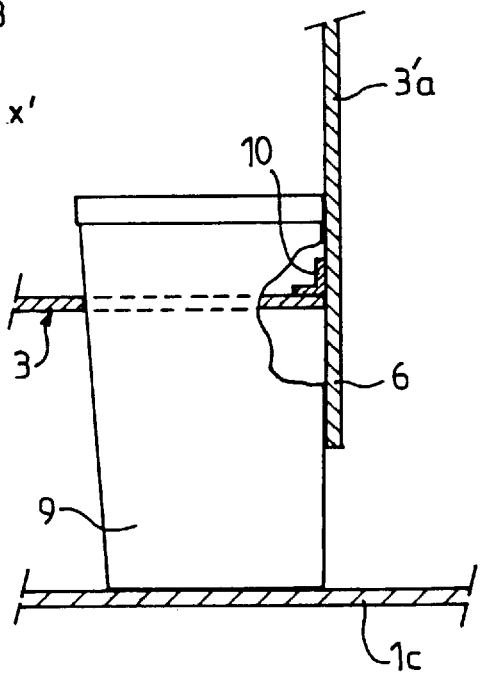
FIG. 9 is a view in fragmentary vertical and longitudinal cross section of a modified embodiment of the invention.

Of course, the flap 3*a* could also be constituted of a member other than the separator plate 3. Thus, in FIG. 9, there is shown a flap 3'*a,* made of an insulating material, such as particularly expanded polystyrene, which is secured on the separate plate 3 by an adhesive cloth 10 which fulfills the function of a spring, the portion of the flap 3'*a* located below the plate 3 constituting the tongue 6.

I claim:

1. Transport bag having a plurality of walls and a bottom, comprising a substantial rigid separator plate which is secured on the internal surface of one of the walls of the bag, said separator plate adapted to selectively occupy one of two positions, namely a storage position in which the separator plate is applied against the wall of the bag, and a use position in which the separator plate extends transversely to the wall within the bag, substantially parallel to the bottom of the bag, said separator plate comprising a first opening for maintaining a first object in a predetermined fixed position when the separator plate is in the use position, said bag including a transverse flap which is articulated on the separator plate so as to be in the plane of the separator plate in the storage position, and perpendicular to the separator plate in the use position, said flap comprising in the use position, a first portion located below and a second portion located above the separator plate, said separator plate having a second opening adjacent the flap for accommodating a second object, which when placed within said second opening, comes into bearing against the first portion so as to maintain the flap substantially perpendicular to the separator plate.

2. Bag according to claim 1, wherein the flap is of a single piece with the separate plate.

3. Bag according to claim 1, wherein the flap is constituted of a thermally-insulated material.

4. Bag according to claim 1, wherein the flap is covered with a thermally-insulating material.

5. Bag according to claim 1, wherein the length of the first portion is equal to the distance separating the separator plate from the bottom of the bag when said separator plate is in the use position.

6. Bag according to claim 1, wherein the separator has two longitudinal sides, and comprises on one of its longitudinal sides a bendable leg which comes into contact, in the use position, with the bottom of the bag.

7. Bag according to claim 1, wherein the separator plate comprises securement means adapted to coact with holding elements disposed on a wall of the bag.

8. Bag according to claim 7, wherein the securement means include at least one tongue and the holding elements include at least one opening provided in the wall of the bag.

9. Bag according to claim 7, wherein the securement means include at least one tongue whose external surface is provided with an adhesive for ensuring its securement on said wall of the bag.

* * * * *